US005461999A

United States Patent [19]

Marcangelo

[11] Patent Number: 5,461,999

[45] Date of Patent: Oct. 31, 1995

[54] EDGE GUIDING APPARATUS FOR SEWING MACHINES

[76] Inventor: Steven Marcangelo, 45 Burgandy Dr., Nashua, N.H. 03062

[21] Appl. No.: 224,626

[22] Filed: Apr. 6, 1994

[51] Int. Cl.[6] ..... D05B 27/10

[52] U.S. Cl. ..... 112/306; 112/153; 226/17

[58] Field of Search ..... 112/121.11, 306, 112/318, 322, 308, 153; 226/15, 17, 19, 21, 23

[56] References Cited

U.S. PATENT DOCUMENTS

| | | | |
|---|---|---|---|
| 3,752,377 | 8/1973 | Knapp | 226/17 X |
| 3,889,614 | 6/1975 | Nicolay et al. | 112/318 X |
| 4,376,415 | 3/1983 | Willenbacher . | |
| 4,719,864 | 1/1988 | Barrett et al. . | |
| 4,827,358 | 5/1989 | Horie et al. . | |
| 4,836,119 | 6/1989 | Siraco et al. . | |
| 5,020,460 | 6/1991 | Babson et al. . | |
| 5,186,115 | 2/1993 | Rouleau et al. | 112/306 |

*Primary Examiner*—Peter Nerbun
*Attorney, Agent, or Firm*—Pearson & Pearson

[57] ABSTRACT

Edge guiding apparatus for a sewing machine that controls the position of a fabric ply edge relative to a reference line. A friction wheel feeds a fabric ply toward a sewing station. If the fabric ply edge displaces from the reference line, control circuitry energizes a drive motor that displaces the friction wheel along an axis perpendicular to the reference line. Simultaneously the friction wheel pivots about a support axis that is orthogonal to a plane containing the reference line and displacement axis. Pressure apparatus holds the friction wheel against a fabric ply with a substantially constant force.

11 Claims, 6 Drawing Sheets

EDGE GUIDING APPARATUS FOR SEWING MACHINES

BACKGROUND OF THE INVENTION

1. Field of the Invention

This invention is generally related to the alignment of fabric in sewing machines and more specifically to the automatic alignment of multiple fabric plies prior to stitching in a sewing machine.

2. Description of Related Art

Sewing machines have a wide range of applications, including stitching fabric plies to form a seam. Generally prior art sewing machines include apparatus for feeding fabric plies to a sewing station where a reciprocating needle, thread and bobbin interact to stitch the fabric plies together. In addition, these machines include apparatus for delivering the edges of the fabric plies along a line such that the seam is a fixed distance from the edge and for maintaining the fabric edge along such a line.

The following United States Letters Patent disclose various prior art approaches for feeding and aligning fabric with respect to a sewing station:

U.S. Pat. No. 4,376,415 (1983) Willenbacher
U.S. Pat. No. 4,719,864 (1988) Barrett et al.
U.S. Pat. No. 4,827,858 (1989) Horio et al.
U.S. Pat. No. 4,836,119 (1989) Siraco et al.
U.S. Pat. No. 5,020,460 (1991) Babson et al.

U.S. Pat. No. 4,376,415 to Willenbacher discloses a device for sewing fabric plies together in contour alignment. A cutting mechanism is provided ahead of a sewing or stitching station in a fabric feed direction. A guide unit senses the contour of the fabric edge and controls the cutting mechanism. The fabric plies are secured to each other by spot sealing at some locations whereby a sealing tape is introduced between the plies. This sealing prevents any relative displacement of the plies as they are fed toward the sewing station.

U.S. Pat. No. 4,719,864 to Barrett et al. discloses a limp material seam joining apparatus with a rotatable limp material feed assembly. A selectively operated feeder located coaxially with a needle at a sewing station that reciprocates along a needle axis, transports regions of the material or fabric along a support surface. An orientation controller establishes an angular orientation of the feeder which is selectively rotatable about the needle axis, with respect to the needle. Thus, the offset of the feed axis may be adjusted with respect to a reference axis on the fabric support surface. This apparatus is stated to facilitate the production of curvilinear seams without having to rotate entire sewing machine relative to the fabric or the fabric relative to the sewing machine.

U.S. Pat. No. 4,827,858 to Horio et al. discloses an edge tracing sewing machine having the capability of adjusting needle position automatically. An edge sensor detects the position of a fabric edge in a lateral direction perpendicular to a feed direction. A tracing control device controls a relative position between the needle and the fabric in the lateral direction to form stitches along a line a predetermined distance from the edge. The tracing control device adjusts the relative lateral position between the needle and the fabric edge thereby to maintain a constant offset between the stitching line and the edge.

U.S. Pat. No. 4,836,119 to Siraco et al. discloses a spherical ball positioning apparatus for guiding fabric plies to a sewing station. As a fabric ply slips across a work surface, a drive train, which has one or more drive wheels fictionally engaging a spherical ball, adjusts the fabric feed direction. The drive wheels are preferably located in a spaced, mutually orthogonal relation proximate a great circle on the ball. The relative rotation of the drive wheels causes the spherical ball to rotate and move the fabric in a direction dependent upon the location and orientation of that drive wheel.

U.S. Pat. No. 5,020,460 to Babson et al. discloses apparatus that aligns a fabric ply in a sewing machine using a friction wheel. The friction wheel applies a force to the ply having a component in a direction transverse to the direction of travel. Sensors indicate the lateral position of the edge of the ply. Signals from the sensors and other sources then are combined to control the angular position of the wheel about an axis normal to the fabric ply.

As will be apparent, each of the foregoing U.S. Letters Patent discloses a different approach for directing fabric plies to a sewing station. However, when viewed in their entirety, each approach incurs different operating weaknesses that can be detrimental to the speed or cost of producing a seam. For example, the Willenbacher patent requires spot sealing and the application of sealing tape. The addition of the sealing tape obviously increases the cost of preparing a seam and the complexity of the seaming and feeding operation. The Barrett et al. and Babson et al. patents disclose apparatus in the form of a belt or wheel for changing the feed direction into a sewing station by changing the angular feed direction in the sewing station. Moreover, in each system complex sensor arrays or other inputs taken with the limitation of changing only the angular direction of fabric feed introduce significant time delays between the time the sensors determine a positioning error exists and the time the correction is completed. The Horio et al. provides, as an alternative, the lateral displacement of the needle relative to a feed reference line thereby to increase any error correction. However, this apparatus requires complicated control equipment that adds to the overall cost of preparing a seam. Although the Siraco et al. patent with its driving spherical ball provides two degrees of control, namely, parallel and perpendicular to a feed reference line, the apparatus for maintaining contact and driving the spherical ball can be complicated and expensive thereby adding to the costs of sewing a seam and the reliability of the apparatus.

SUMMARY

Therefore, it is an object of this invention to provide an improved edge guide apparatus for directing fabric plies to a sewing station.

Another object of this invention is to provide an improved edge guide apparatus for directing fabric plies to a sewing station having two degrees of displacement control.

Still another object of this invention is to provide an improved edge guide apparatus for directing fabric plies to a sewing station in which the angular feed direction and the lateral position can be altered simultaneously.

Still another object of this invention is to provide an improved edge guide apparatus for directing fabric plies to a sewing station in which the angular feed direction and the lateral position can be altered simultaneously without the requirement for complex control circuitry.

Still another object of this invention is to provide an improved edge guide apparatus for directing fabric plies to a sewing station that is inexpensive to implement and that is reliable in operation.

In accordance with this invention, edge guiding apparatus feeds fabric in a fabric plane to a sewing station with an edge to be aligned with a reference line through a reference point. The apparatus aligns the fabric edge parallel and proximate to the reference line and comprises a friction wheel rotatable about an axle parallel to the fabric for engaging the fabric. An axle support connects to the axle and rotates about a support axis transverse to the fabric plane. A linear drive connects to the axle support in order to displace the friction wheel along a displacement axis transverse to the reference line and parallel to the fabric plane. Another drive rotates the axle support about the support axis in response to displacement of the axle support along the displacement axis. Consequently, the friction wheel displaces the fabric along the displacement axis while simultaneously angularly displacing about the support axis to change the fabric feed angle to a sewing station.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Edge guide apparatus 10 constructed in accordance with this invention includes a base with an upper surface 11U and lower surface 11L normally lying, as shown in FIGS. 1 through 5, in a horizontal plane. This base divides the apparatus in an upper section 12U and a lower section 12L. An upper fabric ply 13U advances along the upper surface 11U; a lower ply 13L, along the lower surface 11L. In the following discussion, like references refer to like elements in the upper and lower sections 12U and 12L, with the suffixes "U" and "L" denote the upper and lower sections, respectively.

Friction wheels 14U and 14L drive or feed the upper and lower fabric plies 13U and 13L, respectively, toward a sewing station (not shown) along the upper and lower surfaces 11U and 11L, respectively. Each of friction wheels 14U and 14L also holds its respective fabric ply 13U or 13L against the corresponding base surface 11U or 11L.

Figure 3:
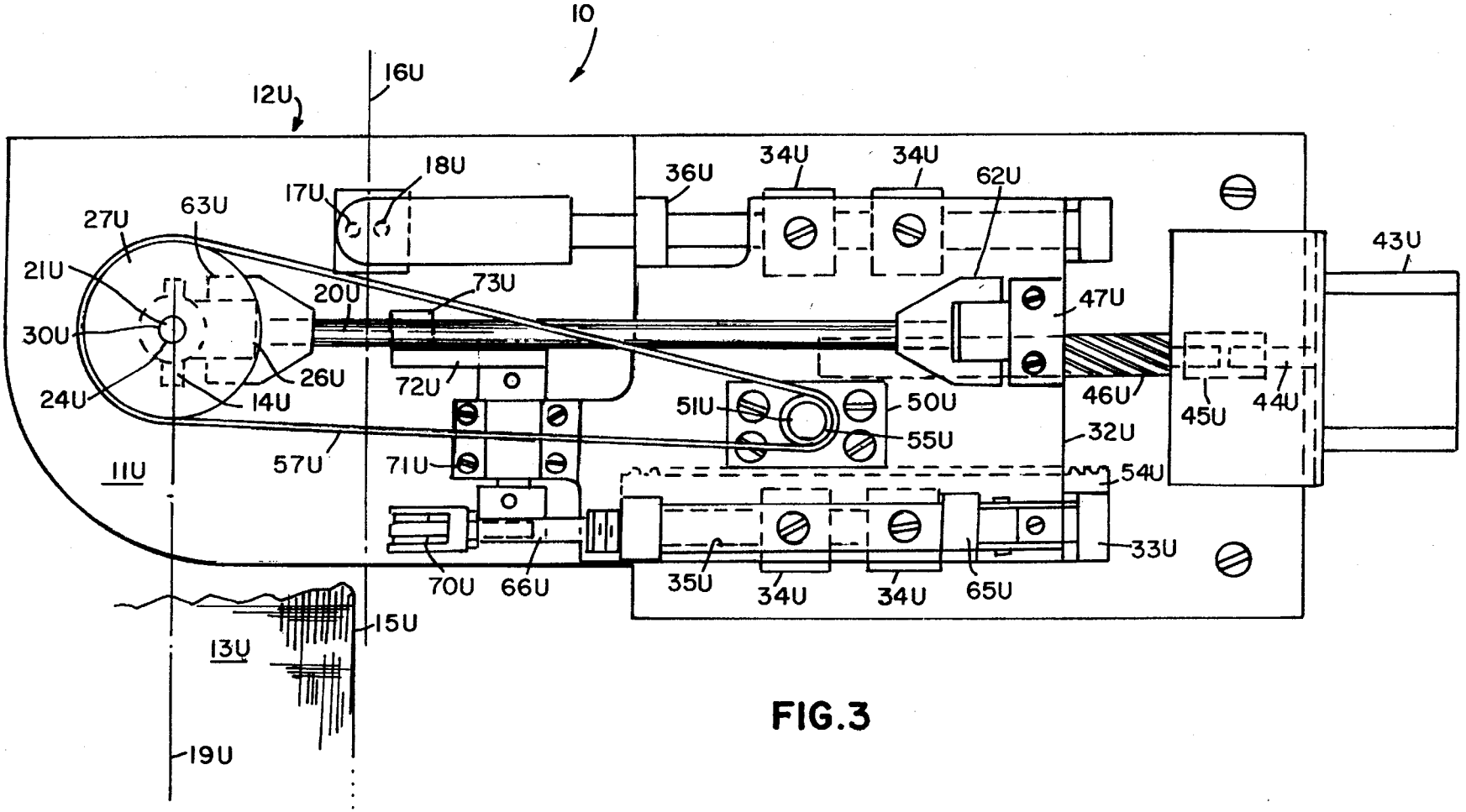
FIG. 3 is a view from the top of the apparatus of FIG. 1.
Figure 4:
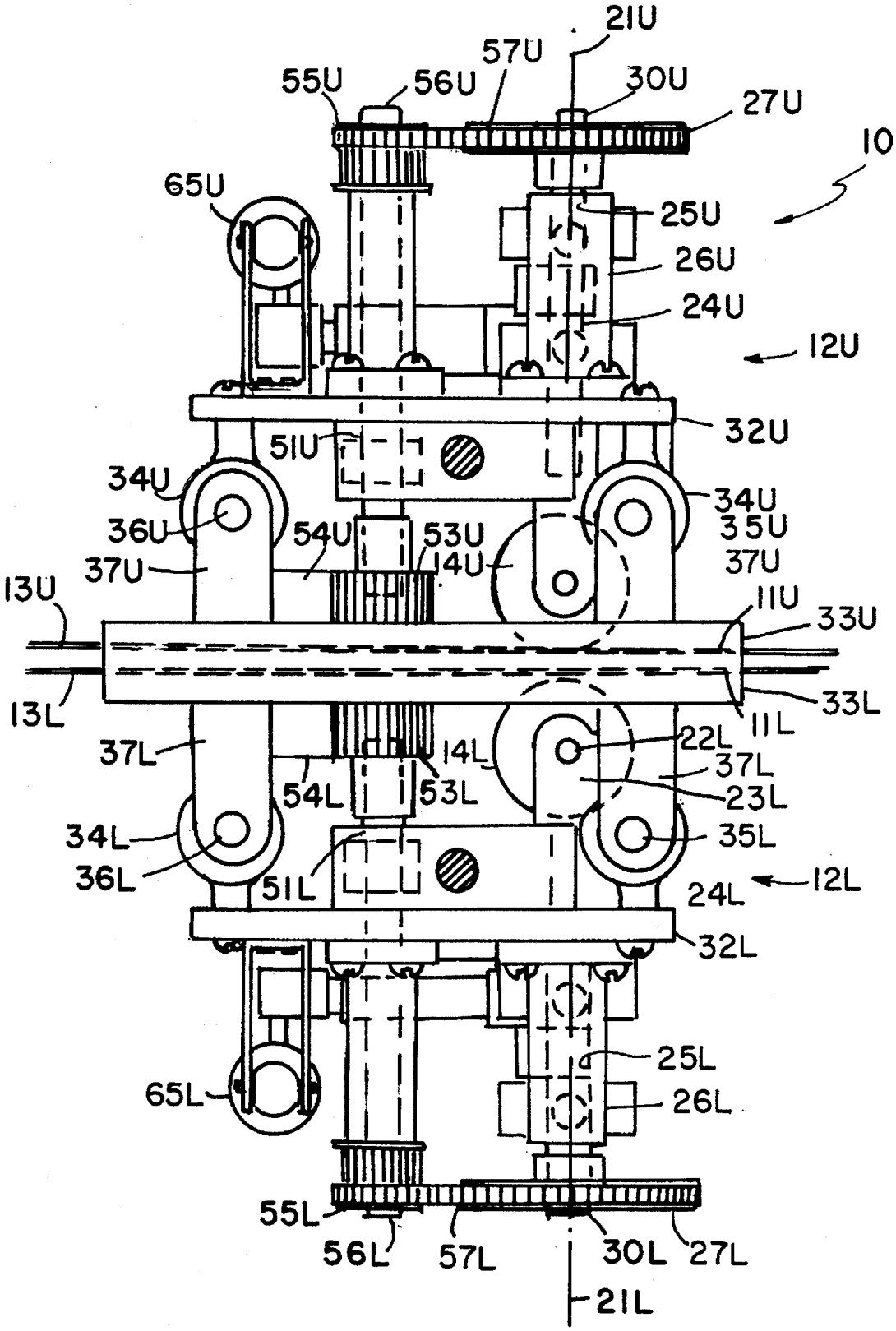
FIG. 4 is a view from the front of the apparatus of FIG. 1.
Figure 5:
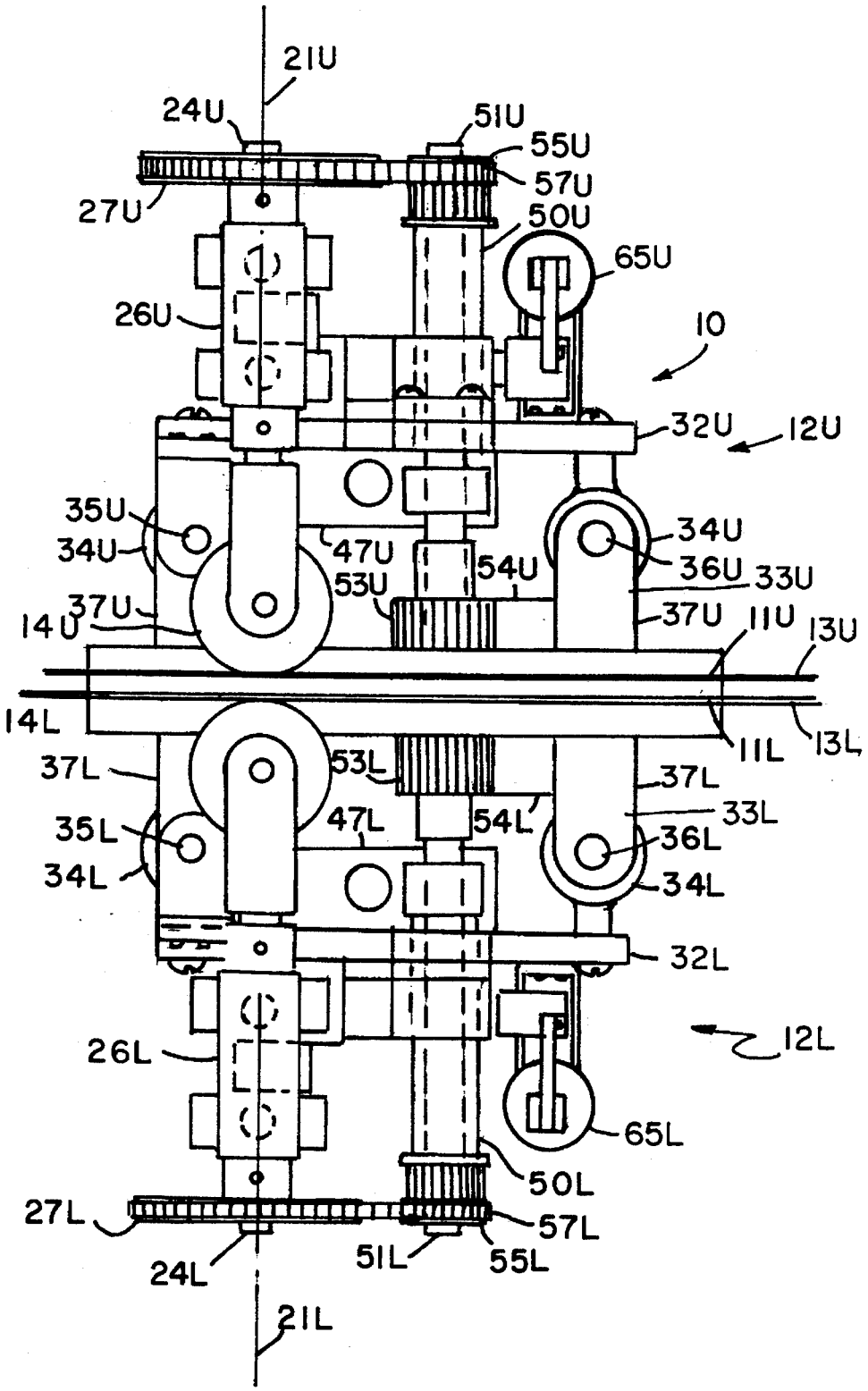
FIG. 5 is a view from the back of the apparatus of FIG. 1.

In FIG. 3 an edge 15U of an upper fabric ply 13U that is coextensive with a reference line 16U. The reference line 16U is parallel to the base support surface 11U and is directed from the front to the back of the apparatus, with "back" referring to the location of the sewing station. In accordance with this invention, a pair of sensors 17U and 18U straddle and define the reference line 16U. The apparatus in the upper section 12U then feeds the fabric ply 13U such that the edge 15U remains on the reference line 16U. When the edge 15U is at the reference line 16U, the sensor 17U will be in one state; the sensor 18U, in an opposite state. For example, if the sensors 17U and 18U are photoelectric detectors, the fabric ply 13U blocks light from reaching sensor 17U, but allows light to reach sensor 18U. If the fabric ply 13U shifts to the right in FIG. 3, the fabric ply 13U blocks light from both sensors 17U and 18U. A similar operation occurs with respect to corresponding sensors 17L and 18L monitoring the edge position of the fabric ply 13L.

It is helpful to an understanding of the apparatus of this invention and its operation to define three orthogonal axes with respect to each of the upper and lower sections 12U and 12L. A first axis 19U in the upper section 12U parallels the reference line 16U and passes through the point of contact between the friction wheel 14U and the upper base surface 11U. The first axis 19U therefore also lies in the plane of the upper base surface 11U. A second axis is a displacement axis 20U that also lies in the plane of the upper base surface 11U and intersects the first axis 19U. The third axis is a support axis 21U that extends through the intersection of the first axis 19U and displacement axis 20U. Normally the support axis 21U is vertically oriented. The lower section 12L will be constructed about analogous first, displacement and support axes.

Prior art apparatus, as previously described, manipulates a feeder, analogous to the friction wheel 14U, either about the support axis 21U or along the displacement axis 20U. In accordance with this invention, the apparatus displaces the friction wheel 14U along the displacement axis 20U and rotates the friction wheel 14U about the support axis 21U as a function of the distance the fabric ply edge 15U moves from the reference line 16U.

Continuing to refer only to the upper section 12U, an axle 22U supports the friction wheel 14U for rotation about an axis parallel to the upper base surface 11U, i.e., a horizontal axis in the particularly disclosed embodiment. A U-shaped clevis or yoke 23U carries the axle 22U. The clevis 23U mounts to the end of a rotatable shaft 24U carried and rotatable in a journal 25U through a support block 26U. A pulley 27U mounts to a remote end 30U of the shaft 24U to provide a means for rotating the shaft 24U about the support axis 21U.

A linkage 31U, described in more detail later, connects the support block 26U to a carriage 32U that reciprocates between first and second positions along the displacement axis 20U. More particularly, the carriage 32U rides on a base 33U. More specifically a plurality of depending linear bearings 34U on the carriage 32U ride along parallel shafts 35U and 36U on the base 33U.

Position sensors 40U, 41U and 42U, which are known in the art and shown as schematic boxes only, define outer limit, home and inner limit positions of the carriage 32U respectively. The home position sensor 41U is active when the carriage 32U positions the friction wheel 14U with the intersection of the axes 19U, 20U and 21U.

An electrical drive motor 43U with an output shaft 44U mounts to the base 33U. A coupling 45U connects the output shaft 44U to a helical gear 46U that extends through a member 47U that depends from the carriage 32U intermediate the bearings 34U. This member 47U and that has a gear structure that mates with the helical gear 46U. As will now be apparent, rotation of the output shaft 44U produces a linear translation of the member 47U and the attached carriage 32U along the displacement axis 20U. As will become apparent later, the drive motor 43U can rotate in opposite directions thereby to reciprocate the carriage 32U and the friction wheel 14U over a range determined by the location of the outer and inner limit sensors 40U and 42U.

As previously stated, the apparatus 10 of this invention also rotates the shaft 24U as a function of the displacement from the home position. The carriage 32U includes a vertically oriented shaft support 50U that carries a vertical shaft 51U. One end 52U of the shaft (e.g., the lower end of section 12U) carries a pinion 53U that engages a rack 54U on the carriage base 33U. Thus as the carriage 32U moves along the displacement axis 20U, the pinion 53U rotates the shaft 51U. A pulley 55U mounts to the upper end 56U of the shaft 51U and rotates with the shaft 51U. A belt 57U, or other link, interconnects the pulley 54U and the pulley 27U on the shaft 24U. Consequently, as the pinion 53U turns during motion of the carriage 32U, the shaft 24U rotates the friction wheel 14U about the support axis 21U. More specifically, whenever the drive motor 43U displaces the carriage 32U toward the inner limit switch 42U, the friction wheel 14U rotates in a clockwise direction when viewed from the top as in FIG. 3. Conversely, motion of the carriage 32U toward the outer limit switch 40U produces a counter-clockwise rotation of the friction wheel 14U.

Additionally if the fabric ply 13U covers both sensors 17U and 18U, the drive motor 43U displaces carriage 32U and the friction wheel 14U toward the outer limit switch 40U (e.g., to the right in FIG. 3) and rotates the friction wheel 14U counter-clockwise to introduce a velocity component to the fabric ply 13U that tends to move the edge 15U toward the reference line 16U (e.g., to the left in FIG. 3). If the edge 15U moves to the left in FIG. 3 and uncovers the sensor 17U, the friction wheel 14U displaces to the right and rotates in a clockwise direction simultaneously to introduce a leftwardly directed velocity component and displacement to the fabric ply 13U.

The ratio of the diameters of the pulleys 27U and 54U establish the specific velocity component that the friction wheel 14U provides. In one embodiment, the ratios are selected so that a ¾" carriage displacement from the home position introduces a 45° rotation of the friction wheel 14U about the support axis 21U. Other ratios can be selected to increase or decrease the rate of angular motion for a given displacement. Typically, however, it is expected that the maximum angular motion should be limited to about 45°.

The specific embodiment shown in FIGS. 1 through 5 includes two fixed pulleys 27U and 54U. It will be apparent that multiple pulley sets or variable diameter pulley sets could mount on the ends of the shafts 18U and 51U to provide a means for providing a variable slope or ratio between angular and linear displacements.

During operation it will be desirable to have the friction wheel 14U apply essentially constant pressure on the fabric along the support axis 21U even as the thickness of a fabric ply varies. At other times it may become necessary to remove a fabric ply, such as the fabric ply 13U, from the apparatus 10. The linkage 31U, shown in particularly in FIGS. 2 and 3, controls the position of and pressure exerted by the friction wheel 14U. This linkage 31U includes a pair of spaced parallel arms 60U and 61U. At one end, each arm connects to the support block 26U at pivots 62U. At the other end, each arm connects by pivots 63U to a bracket 64U attached to the carriage 32. As a result, the support block 26U, arms 60U and 61U and the bracket 64U form a pantograph so that the rotatable shaft 24U remains vertically oriented if the support block 26U moves at right angles to the upper base surface 11U. Over a limit range of angular displacement, elevating the friction wheel 14U does not produce any significant displacement along the displacement axis. Thus, over a range of motions required to accommodate thickness variations in the fabric ply 13U, the friction wheel 14U can be considered as applying pressure at a fixed location on the displacement axis.

Figure 1:
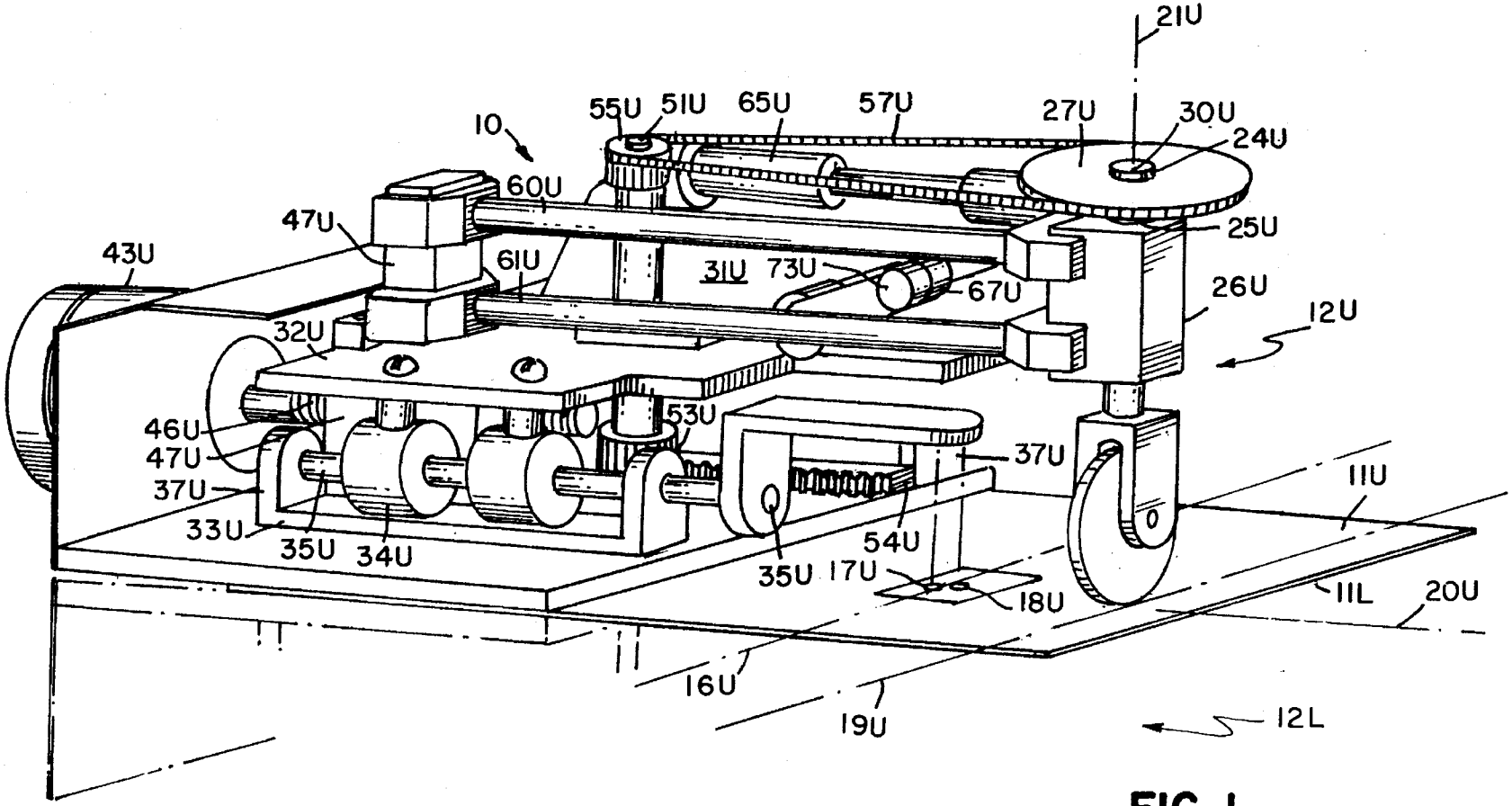
FIG. 1 is a perspective view of an edge guide apparatus constructed in accordance with this invention.
Figure 2:
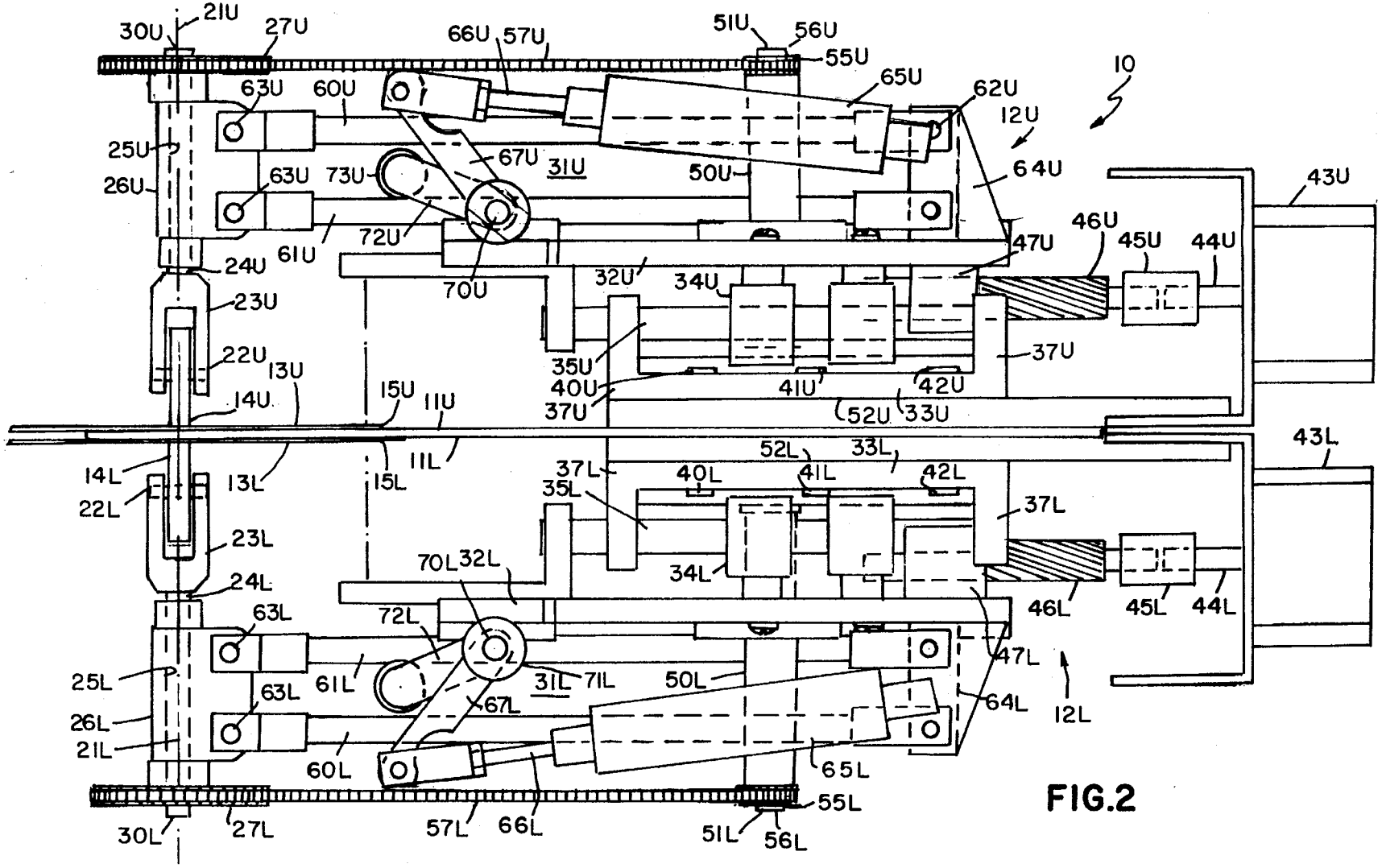
FIG. 2 is a view from the side of the apparatus of FIG. 1.

A pneumatically driven mechanism shown particularly in FIGS. 2 and 3 interacts with the arms 60U and 61L to produce an essentially constant pressure on the friction wheel 14U during normal use. This mechanism also provides a convenient means for moving the friction wheel 14U to a maintenance position where the friction wheel 14U is displaced from the upper base surface 11U. More specifically a pneumatic cylinder 65U attaches pivotally to the bracket 64U, typically at the pivot 63U. A piston shaft 66U pivotally connects to a link 67U that rigidly attaches to a rotatable shaft 70U extending through a bracket 71U on the carriage 32U. Another link 72U also attaches rigidly to the shaft 70U and terminates, at a remote end, with a roller 73U that lies between the arms 60U and 61U.

When the cylinder 65U retracts the piston shaft 66U, the link 67U rotates the shaft 70U and the link 72U in a clockwise direction as viewed in FIG. 2 thereby elevating the arms 60U and 61U and the friction wheel 14U. When pneumatic pressure is applied to the cylinder 65U to extend the piston 66U, the links 67U and 72U rotate in a counter-clockwise direction to move the friction wheel 14U into contact with any fabric ply 13U on the upper base surface 11U. As will be apparent, conventional pressure controllers can be used to regulate the pneumatic pressure acting on the piston 66U so that the friction wheel 14U operates with a constant pressure even as it moves incrementally when fabric ply thickness varies.

Figure 6:
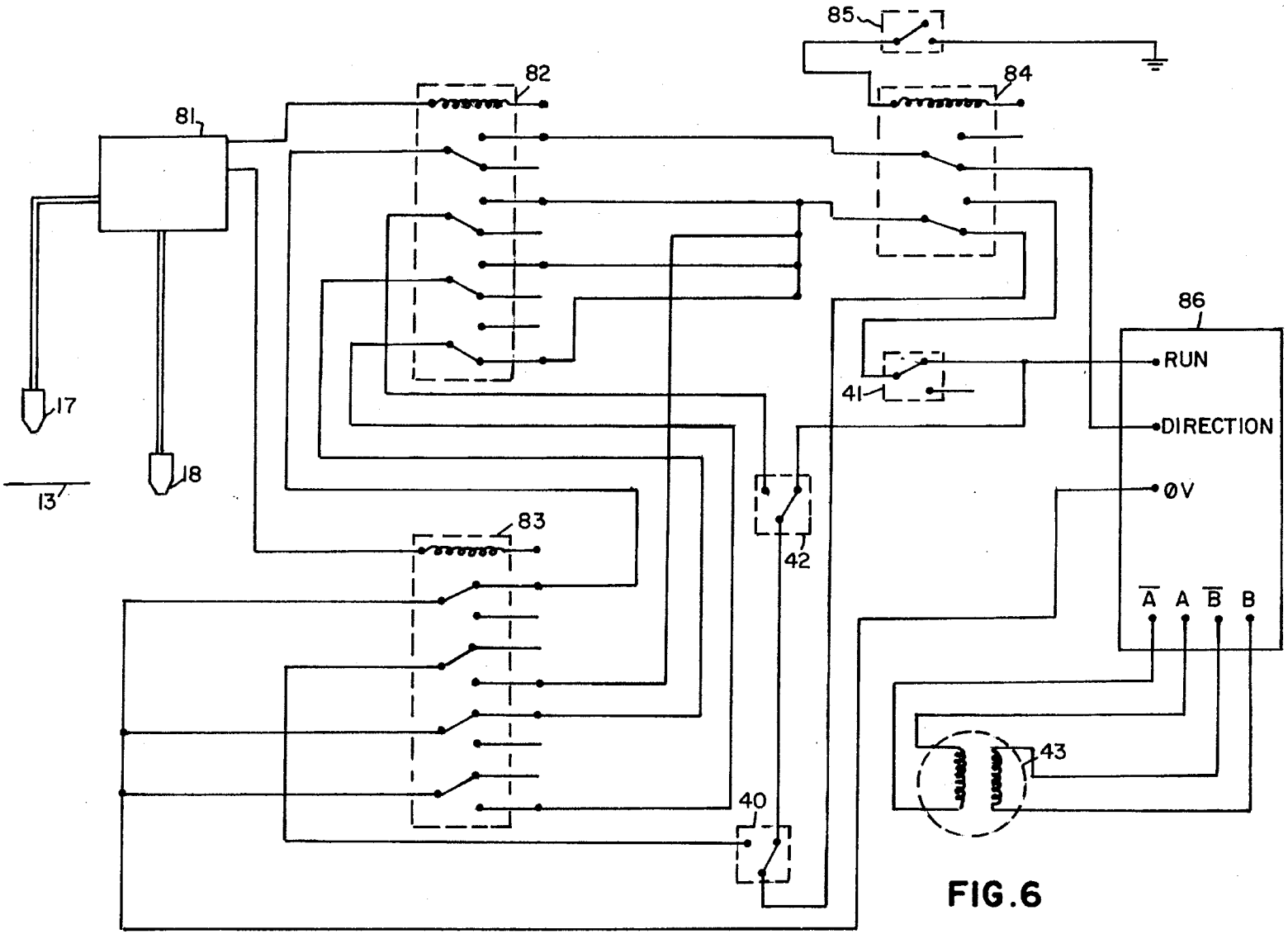
FIG. 6 depicts the control system, in schematic form, for the apparatus shown in FIG. 1.

FIG. 6 schematically depicts a simple control circuit 80 for each drive motor 43 in response to signals from the sensors 17 and 18 and the outer limit, home and inner limit switches 40, 41 and 42. In the following discussion no distinction is made between the upper and lower sections 11U and 11L, so the use of suffices on reference numerals is discontinued.

In the particular embodiment shown in FIG. 6, an amplifier circuit 81 generates or asserts signal whenever one of the sensors 17 or 18, comprising two photodetectors, receives light. These signals are designated as SENSOR 1 ON and SENSOR 2 ON signals in FIG. 6. Each of these signals drives a multi-pole, double-throw relay 82 or 83, respectively. In FIG. 6 the relay 82 is deenergized because the fabric ply 13 is intermediate a light source (not shown) and the photodetector 17. The relay 83 is energized because the fabric ply 13 is not intermediate the photodetector 18 and the light source.

The relays 82 and 83 interconnect with each other and with another relay 84 that a switch 85 energizes whenever the linkage 31 elevates a corresponding friction wheel. During normal operation the switch 85 is an open circuit, so the relay 84 is not energized. A set of RUN and DIRECTION signals from this relay network are inputs to a conventional stepper motor controller 86. The stepper motor controller also produces a control output 0 V signal and a set of outputs that energize a stepper motor that, in this particular embodiment, constitutes the drive motor 43.

In essence, the relays 82, 83 and 84 produce a RUN signal if:

1. There is a need to run as indicated by the assertion or the non-assertion state of the SENSOR 1 ON and SENSOR 2 ON signals simultaneously, and 2. The carriage 32 has displaced from its home position, as indicated by the center switch 41 without reaching either the outer or inner limit, as indicated by the outer and inner limit switches 40 and 42.

The relays 82, 83 and 84 will produce a DIRECTION signal causing the controller 86 to rotate the drive motor 43 so as to move the carriage 32 toward the inner limit switch 42 if both the SENSOR 1 ON and SENSOR 2 ON signals are asserted. If neither the SENSOR 1 ON nor SENSOR 2 ON signals is asserted, the controller 86 responds to the DIRECTION signal by moving the carriage 32 toward the outer limit switch 40. As will be apparent, the control system in FIG. 6 can also be constructed using a conventional programmable controller.

In summary, the apparatus shown in FIGS. 1 through 5 maintains the edge of a fabric ply along a reference line through a reference point between sensors 17 and 18. The apparatus includes a friction wheel 14 that rotates about an axle 22 that parallels a support surface, such as a base surface 11. The axle support, in the form of a clevis 23 at the end of a shaft 24, allows the friction wheel 14 to pivot about a vertical support axis through the shaft 24. A linear drive including a drive motor 43, helical gear 46 and mating member 47 that attaches to a carriage 32 by an interconnecting linkage 31, enable the friction wheel 14 to reciprocate along a displacement axis at substantially right angles to the reference line 16. A rack 54 on a carriage base 33, a pinion 53, pulleys 55 and 27 constitute a means for rotating the axle support about the support axis relative to the linear actuator upon displacement of the linear drive along the displacement axis.

Moreover, it will also be apparent that this apparatus achieves the various objects of this invention. Each of the sections 11U and 11L have the capability of guiding fabric plies to a sewing station. As the friction wheels 14 can rotate about their support axes and move in a linear fashion along a displacement axis simultaneously, the apparatus provides two degrees of displacement control. Further, the apparatus its associated electronic controls are easy and relatively inexpensive to manufacture and are reliable in use.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. In apparatus for receiving fabric in a fabric plane with an edge to be aligned with a reference line through a reference point on the apparatus, edge guiding means for aligning the fabric edge parallel and proximate to the reference line, said guiding means comprising:

A. a friction wheel rotatable about an axle parallel to the fabric for engaging the fabric, B. axle support means connected to the axle and rotatable about a support axis transverse to the fabric plane, C. linear drive means connected to said apparatus and to said axle support means for displacing said friction wheel along a displacement axis transverse to the reference line and parallel to the fabric plane, and D. means connected to said axle support means and to said apparatus for rotating said axle support means about the support axis relative to said linear drive means in response to displacement of said friction wheel along the displacement axis by said linear drive means.

2. Edge guiding means as recited in claim 1 wherein linear drive means comprises control means for generating displacement signals for controlling the direction and displacement of said friction wheel along the displacement axis.

3. Edge guiding means as recited in claim 2 wherein said linear drive means additionally comprises carriage means for carrying said axle support means, means for carrying said carriage means on the apparatus for limited reciprocal motion along the displacement axis and electrical drive means for displacing carriage means in response to the displacement signals from said control means.

4. Edge guiding means as recited in claim 3 wherein said linear drive means additionally comprises a electrically driven stepping motor, means for controlling the operation of said electrically driven stepping motor and means for converting rotary motion of said stepping motor to reciprocal motion of said carriage means.

5. Edge guiding means as recited in claim 3 additionally comprising parallel displacement means pivoted to said carriage means for transporting said rotatable axle means in a plane transverse to the fabric plane.

6. Edge guiding means as recited in claim 5 wherein said parallel displacement means includes a first plate connected to said carriage means, a second plate connected to said rotatable means, first and second spaced, parallel arms pivoted at each end to one of said first and second plate, and pneumatic means pivoted between said first plate and one of said first and second arms for displacing said friction wheel from the fabric.

7. Edge guiding means as recited in claim 3 wherein said control means includes sensor means for monitoring the position of the fabric edge in relationship to the reference line and said control means generates signals that cause said electrical drive means to displace said carriage means thereby to compensate the displacement of the fabric edge from the proximity of the reference line.

8. Edge guiding means as recited in claim 7 wherein control means additionally comprises position means located at said carriage means for defining a home position when said carriage means aligns said friction wheel with said reference line and first and second limit positions displaced oppositely of the home position, said control means being responsive to the state of said position means and said sensor means for generating the displacement signals.

9. Edge guiding means as recited in claim 5 wherein said rotating means includes rotatable drive shaft means on said carriage means, means attached to said rotatable shaft means and said carriage means for rotating said shaft means as said carriage means reciprocates, and linkage means interconnecting said rotatable means and said shaft for causing said rotatable means to turn in response to the rotation of said shaft means.

10. Edge guiding means as recited in claim 9 wherein said linkage means includes pulley means on each of said rotatable means and said rotatable shaft and belt means interconnecting said pulley means, said pulley means establishing the ratio of the angular displacements of said rotatable means and said shaft.

11. Edge guiding means as recited in claim 9 wherein said linkage means includes adjustable pulley means on each of said rotatable means and said shaft and belt means interconnecting said pulley means, said pulley means establishing the ratio of the angular displacements of said rotatable means and said shaft.

* * * * *